US006058664A

United States Patent [19]

Brownlee, III

[11] Patent Number: 6,058,664

[45] Date of Patent: May 9, 2000

[54] DWELLING STRUCTURE WITH VERTICAL ACCESS FROM A PORTABLE UNIT

[76] Inventor: John A. Brownlee, III, 380 Beadling Rd., Pittsburgh, Pa. 15228

[21] Appl. No.: 09/224,935

[22] Filed: Dec. 31, 1998

Related U.S. Application Data

[60] Provisional application No. 60/070,252, Dec. 31, 1997.

[51] Int. Cl.[7] ..... E04D 13/18

[52] U.S. Cl. ..... 52/173.1; 52/67; 52/79.8; 52/175; 52/185; 296/216; 414/228; 414/401

[58] Field of Search ..... 52/79.1, 79.7, 52/79.8, 79.9, 143, 173.1, 169.4, 175, 183, 185, 67; 296/216, 219, 156, 165, 171; 414/227, 228, 401

[56] References Cited

U.S. PATENT DOCUMENTS

| | | | |
|---|---|---|---|
| 2,840,866 | 7/1958 | Paulsen . | |
| 4,250,669 | 2/1981 | Freeauf | 52/79.8 |
| 4,499,696 | 2/1985 | Freeauf | 52/79.8 |
| 5,299,791 | 4/1994 | Schlapp | 296/219 |
| 5,613,728 | 3/1997 | Smith et al. | 296/219 |
| 5,809,704 | 9/1998 | Stewart et al. | 52/169.4 |
| 5,890,330 | 4/1999 | Lesage | 52/183 |

*Primary Examiner*—Carl D. Friedman
*Assistant Examiner*—Yvonne M. Horton
*Attorney, Agent, or Firm*—Christopher P. Ricci

[57] ABSTRACT

A dwelling system having a housing which lacks plumbing. The housing is elevated so as to accept a portable unit below the housing. The housing uses a mating structure to provide bi-directional access through the roof of the portable unit that plumbing is provided by the portable unit.

9 Claims, 2 Drawing Sheets

DWELLING STRUCTURE WITH VERTICAL ACCESS FROM A PORTABLE UNIT

This application claims benefit of Provisional Application 60/070,052 filed Dec. 31, 1997.

BACKGROUND OF THE INVENTION

The present invention relates generally to apparatus and methods for mechanically interconnecting a housing with a portable vehicle. More particularly, the invention relates to apparatus and method for interconnecting a housing structure that lacks sanitary facilities with a portable vehicle that has such sanitary facilities and doing so in such a way that the portable vehicle is fully enclosed within the housing structure.

Motor homes, mobile homes and recreational vehicles (collectively referred to as "RVs") have recently enjoyed an increase in popularity. RV's provide a spontaneous mobility that is relatively inexpensive as opposed to a fixed dwelling which is generally more expensive and is immovable. The fixed dwelling, however, provides the owner a relatively spacious living area and is a welcome addition to most communities. In contrast, the disadvantages of RVs involve the rather cramped general living quarters and the question of availability of space at campsites for such large structures.

When building a fixed dwelling, a disproportionately large amount is paid for plumbing, bathroom facilities and kitchen facilities. Approximately 30% to 45% of the cost of the home is dedicated to these necessities. While the RV may be driven away at the owner's whim, the fixed dwelling, particularly in climates which are subject to severe winter conditions, must be "winterized" when temporarily abandoned in favor of warmer climates. Winterizing is necessary when the heat in the fixed dwelling is to be turned off since there will be no occupants. Since there is no heat, the pipes must be drained to prevent the freezing of the pipes contained therein. While this avoids the high cost of heating the home over a winter, there is a significant burden of draining the pipes and then opening the house upon return.

One commercially available system that resolves some of these issues is described in U.S. Pat. No. 4,250,669 entitled "Dwelling Structure" issued Feb. 17, 1981, to Robert F. Freehoff, and U.S. Pat. No. 4,499,696 entitled "Dwelling Structure" issued Feb. 19, 1985, to Robert F. Freehoff. These patents address a system for interconnecting a permanent dwelling structure with a RV which has kitchen and bathroom facilities. Thus, when the owner of the RV chooses to leave, there is no need to winterize the dwelling structure since the plumbing used by the dwelling structure is disposed in the RV. A disadvantage of this system is that the interconnection between the mobile vehicle and the dwelling structure is through a lateral surface. That is, the mobile vehicle is pulled along side of the dwelling structure and an air tight seal is made between the two to interconnect. However, since these are fixed dwellings, the dwelling structure may not be situated on a lot wide enough to accommodate this kind of interconnection. That is, to keep the cost of the lot and dwelling insubstantial the size of the lot is minimized and/or the size of the structure is maximized to fill the size of the lot. This is particularly evident in RV parks that have lots substantially equal to the width of the RV. The foregoing commercially available structure does not fit in a RV park, and at a minimum would require the dwelling structure to be downsized at least by the width of the RV. Under some circumstances, the foregoing structures may have another disadvantage: the interconnection between the mobile vehicle and the dwelling structure is through a lateral surface. That is, the mobile vehicle is pulled along side of the dwelling structure and an air tight seal is made between the two to interconnect. However, the dwelling structure may not be situated on a lot wide enough to accommodate this kind of interconnection. That is, to keep the cost of the lot and dwelling insubstantial the size of the lot is minimized and/or the size of the structure is maximized to fill the size of the lot. This is particularly evident in RV parks that have lots substantially equal to the width of the RV. The foregoing commercially available structure does not fit in an RV park, and at a minimum would require the dwelling structure to be downsized at least by the width of the RV.

Accordingly, it is an object of this invention to provide a dwelling structure that lacks sanitary facilities but is adapted to interconnect with the mobile vehicle that contains such sanitary facilities.

It is another object to this invention to provide a RV and dwelling combination which does not decrease the width of the dwelling alone.

It is a further object to this invention to provide a RV and dwelling combination that will fit in RV parks.

These and other objects of the invention will be obvious and will appear hereinafter.

SUMMARY

The aforementioned and other objects are achieved by the invention which provides a dwelling system and a method associated therewith. The dwelling system comprises a portable unit and a housing.

The portable unit is generally a vehicle which is mobily disposed and has sanitary facilities disposed therein. Examples of such portable units are recreational vehicles and mobile homes.

Generally, the housing has one or more rooms and is optionally a structure in which one or more people could dwell therein. However, the housing lacks sanitary facilities and will often lack all types of plumbing.

The housing is adapted to mechanically interconnect with the portable unit. The mechanical interconnection occurs vertically such that the roof of the portable unit opens to receive a mating structure, such as stairs or a ladder for example, from the housing. The mating structure is disposed in the housing above the portable unit.

In further aspects, the invention provides methods in accord with the apparatus described above. The aforementioned and other aspects of the invention are evident in the drawings and in the description that follows.

BRIEF DESCRIPTION OF THE DRAWINGS

The foregoing and other objects of this invention, the various features thereof, as well as the invention itself, may be more fully understood from the following description, when read together with the accompanying drawings in which.

DETAILED DESCRIPTION

While the present invention retains utility within a wide variety of dwelling systems and may be embodied in several different forms, it is advantageously employed in connection with motor homes, recreational vehicles ("RV") and mobile homes. Though this is the form of the preferred embodiment and will be described as such, this embodiment should be considered illustrative and not restrictive. The distinction generally drawn between motor homes, recreational vehicles and mobile homes is that motor homes are generally self-propelled while recreational vehicles and mobile homes are generally pulled by another vehicle. One skilled in the art will realize that the invention is useful with any such type of vehicle and is also useful with numerous other large vehicles that may not readily fit into a conventional garage. Therefore, as used herein, the term "portable unit" shall be defined as any such vehicle without limitation.

Figure 1:
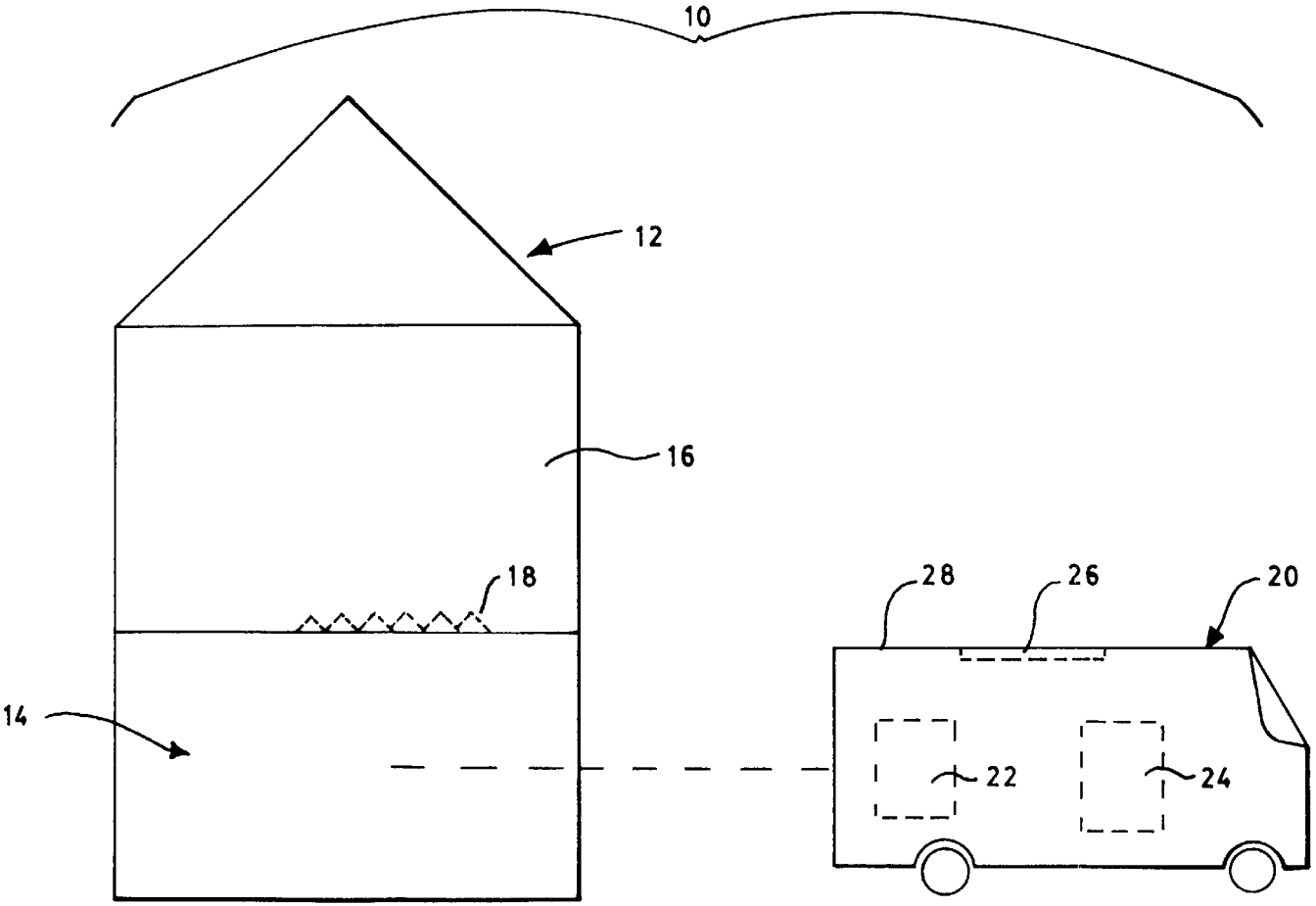
FIG. 1 shows a cross-sectional side view of the dwelling system of the invention.

FIG. 1 shows a cross-sectional view of the dwelling system 10 where a housing 12 is adapted to receive a portable unit 20. In this embodiment, the housing 12 is structured so as to receive the portable unit 20 below a living area 16. The housing 10 is, in this embodiment, sized to accommodate the portable unit 20 within a chamber 14 below the living area 16. The housing 12, and therefore the living area 16, can then be sized to maximize the square footage of living space given the lot size.

Figure 2:
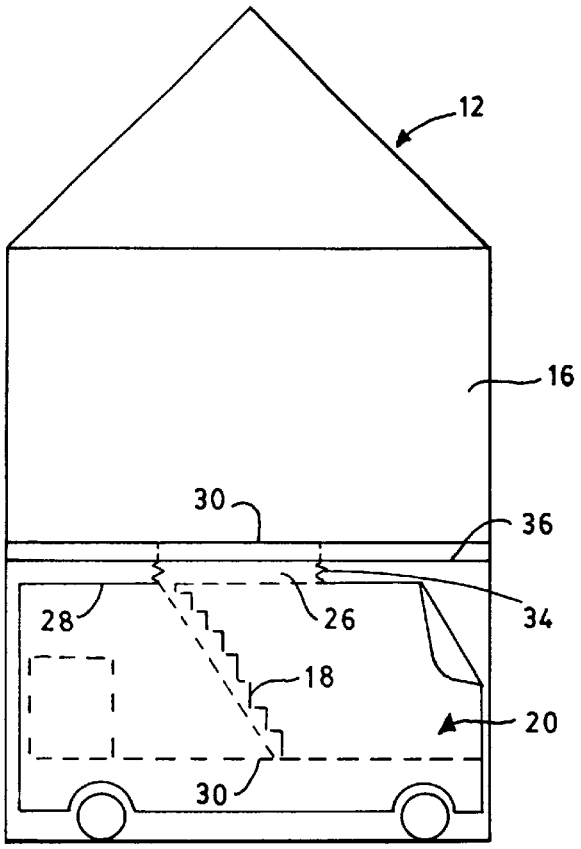
FIG. 2 shows a cross-sectional side view of the portable unit disposed under a housing as per the invention.

Referring now to FIGS. 1 and 2, access to the portable unit 20 from the housing 12 achieved through an access way 26 disposed in a roof 28 of the portable unit 20. The access way 26 has a weather tight door which when in a normally closed position seals the interior of the portable unit 20 from external elements.

In other embodiments, however, the need for a weather tight door would be unnecessary. For example, the housing 12 could be accessed by exiting the portable unit 20 from a side door and then using an access way, such as stairs, offset to a side of the portable unit 20 to enter the housing 12. In such an embodiment during entry into a living area 16, the occupants would be protected from external elements from above, but not from the side. Other offset forms of access ways should be readily apparent.

When using the door on the roof 28, however, the access way 26 is retractable in any of numerous ways well known in the art to open the access way 26. For example, the weather tight door could retract into a adjoining portion of the roof, could rotate relative to the roof such that it is directly behind a mating structure 18, or any of various other structures well known in the art.

Once the access way 26 is open, the mating structure 18, such as the stairs which are illustrated for example, are withdrawn from an aperture 30 in the housing floor 36 and the mating structure 18 is drawn into the access way 26. One skilled in the art will realize that any structure that provides vertical access can serve as the mating structure 18. Other examples are telescoping ladders and elevators. The mating structure 18 is retractable into the housing 12 and is lockable in that position to insure security to the housing 12. The method of retraction is again design specific and ranges from a manual spring-biased structure to a structure having electric motors to cause retraction and engagement, for example. In the preferred embodiment, each such mating structure 18 can be locked, and in one embodiment engaged, using a key at ground level.

For homes that are known to be unoccupied for long periods of time, an elevated and lockable mating structure 18 is a desirable element of security. If the mating structure 18 is the primary means of ingress, an intruder would need a ladder to enter the housing 12, thus becoming highly visible thereby discouraging such actions.

When the mating structure 18 is unlocked, a force moves the mating structure 18 into an engaged position. That force may be purely mechanical, use electric motors, or some combination thereof. In the illustrated embodiment, the mating structure 18 is a flight of stairs which is rotatably connected at one end to the housing 12. The force is manual and is actuated by pulling a rope from below or pushing down from above, though electric motors can be substituted without detriment to the invention.

Actuation as described causes the mating structure 18 to rotate about hinges mechanically connected to the mating structure 18. Once fully engaged, the mating structure 18 locks in position.

In the engaged position, the mating structure 18 is in mechanical contact with a floor 32 of the portable unit 20. Occupants of the living area 16 then access the facilities of the portable unit 20 by walking down the mating structure 18 into the portable unit 20. Examples of such facilities would be sanitary facilities 22, such as a toilet and a sink and a kitchen area 24. Since the facilities that require plumbing, such as the sanitation facilities 22, are disposed within the portable unit 20, the housing 12 need not have plumbing. Thus, the requirement of winterizing the housing 12 when the housing 12 is unoccupied for any long period of time is avoided and the overall cost of constructing the housing 12 are minimized.

Referring now to FIG. 2, there is shown an enlarged view of the preferred mechanical interconnection between the housing 12 and the portable unit 20. As previously described, the mating structure 18 passes through the access way 26 to provide convenient access from the housing to the portable unit 20. In order to minimize external influences, a sleeve 34 is secured between the housing floor 36 and the roof 28 of the portable unit 20. In the preferred embodiment, the sleeve 34 has a magnetic strip that secures the sleeve to the roof 28.

The above-described embodiment shows a means by which the portable unit 20 is accessed from the housing 12 and the space necessary for the mechanical interconnection of the two dwellings is minimized. However, the portable unit 20 in that embodiment is fully exposed to passersby.

Figure 3:
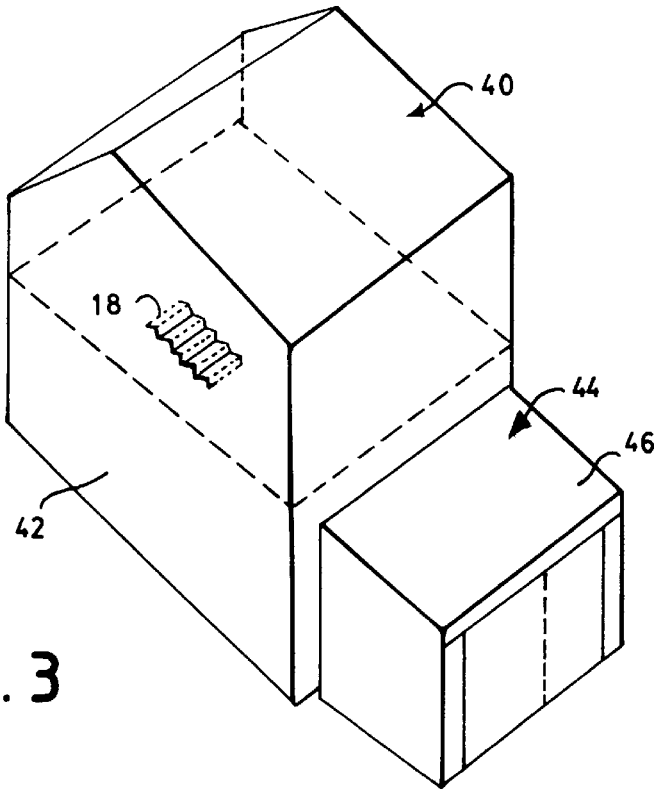
FIG. 3 shows a perspective 1 view of the housing of the invention where the mating structure is fully retracted.

FIG. 3 illustrates an embodiment where the mating structure 18 is fully retracted within the housing 40 and the portable unit 20 is fully enclosable therein.

This embodiment illustrates how a portable unit 20 that is longer than the width of the housing 40 is enclosed therein. To manage the additional width of the portable unit 20, a garage addition 44 extends from the housing 40. The enclosed space below the living area 16 and the area enclosed by the garage addition 44 define a chamber 42 where the portable unit 20 is ultimately stored.

The invention may be embodied in other specific forms without departing from the spirit or essential characteristics thereof. The present embodiments are, therefore, to be considered in all respects as illustrative and not restrictive, the scope of the invention being indicated by the appended claims rather than by the foregoing description, and all changes which come within the meaning and range of equivalency of the claims are therefore intended to be embraced therein.

The embodiments of the invention in which an exclusive property or privilege is claimed are defined as follows:

1. A dwelling system comprising:

a portable unit mobily disposed having a roof and an access way disposed in the roof; and a housing elevated to form a chamber below the housing such that the portable unit is selectively movable into the chamber and having a mating structure adapted to enter an interior portion of the portable unit through the access way thereby providing bi-directional access to the portable unit from the housing where securing the mating structure between the housing and the portable unit makes the portable unit integral therewith.

2. The dwelling system according to claim 1 wherein the mating structure is an elevator which is selectively indroduced into the interior of the portable unit from the housing.

3. The dwelling system according to claim 1 wherein the mating structure is retractable between an engaged position and a disengaged position where in the engaged position the housing is mated with the portable unit and in the disengaged position the housing and the portable unit are mechanically isolated.

4. The dwelling system according to claim 3 wherein the mating structure extends to an external portion of the housing in the engaged position and is lockable in the disengaged positions.

5. A permanently fixed housing adapted to receive a portable unit below the housing, said housing being devoid of plumbing facilities, said permanently fixed housing comprising:

a living area;

interconnection means positioned proximate to the portable unit for joining the portable unit to said housing through a roof of the portable unit for making a secure connection therebetween and for making a complete functional home when joined.

6. A combination of a housing and a portable unit where the portable unit is mobily disposed and the housing is fixed and the portable unit is adapted to securely interconnect with the housing between a roof of the portable unit and a floor of the housing to become and integral part thereof.

7. The combination according to claim 6 wherein the housing lacks sanitary facilities and the portable unit has sanitary facilities.

8. The combination according to claim 6 wherein the housing provides is void of plumbing and, when interconnected with the portable unit, the housing has direct access to rooms requiring such plumbing.

9. The combination according to claim 6 wherein the combination has a first mode where the mobile unit is mobile apart from the housing and the housing lacks facilities contained within the mobile unit, and has a second mode where the mobile unit is connected to the housing to provide such facilities and to form a complete living area.

* * * * *